US005240217A

United States Patent [19]

Lizakowski

[11] Patent Number: 5,240,217

[45] Date of Patent: Aug. 31, 1993

[54] HIGHWAY MARKER BRACKETS

[76] Inventor: Allen J. Lizakowski, 4414 Black Walnut Woods, San Antonio, Tex. 78249

[21] Appl. No.: 795,692

[22] Filed: Nov. 21, 1991

[51] Int. Cl.[5] ..... A47F 5/00

[52] U.S. Cl. ..... 248/300; 256/65; 256/DIG. 4; 248/201; 248/558; 182/151; 182/153

[58] Field of Search ..... 403/403, 400, 405.1, 403/314, 384; 404/6, 9; 108/110; 256/65, DIG. 4; 248/300, 201, 205.1, 220.2, 235, 558; 182/181, 153, 151

[56] References Cited

U.S. PATENT DOCUMENTS

| | | | |
|---|---|---|---|
| 226,431 | 4/1880 | Warner | 182/181 |
| 467,081 | 1/1892 | Church | 182/151 |
| 841,931 | 1/1907 | Chesebro | 182/181 |
| 889,223 | 6/1908 | Graham | 403/405.1 X |
| 1,037,122 | 8/1912 | Buffinger et al. | 248/300 |
| 1,322,203 | 11/1919 | Schroeder | 403/403 X |
| 1,757,280 | 5/1930 | Withrow | 248/300 |
| 1,767,575 | 6/1930 | Bujack | 248/300 |
| 2,055,285 | 9/1936 | Ford | 248/300 |
| 3,268,252 | 1/1964 | Rolland | 248/218.4 X |
| 3,352,084 | 11/1967 | Seery | 256/65 X |
| 3,415,554 | 12/1968 | Papayoti | 403/388 X |
| 4,014,618 | 3/1977 | Kristiansen | 403/403 X |
| 4,102,434 | 7/1978 | Blank | 182/181 |
| 4,183,695 | 1/1980 | Wilcox | 404/6 |
| 4,369,953 | 1/1983 | Greiner et al. | 256/65 X |
| 4,421,305 | 12/1983 | Kosmowski | 269/903 X |
| 4,593,877 | 6/1986 | Von Der Wyk | 248/538 X |
| 4,616,950 | 10/1986 | Morris | 256/65 X |
| 4,785,911 | 11/1988 | Kayl | 182/181 X |
| 4,923,163 | 5/1990 | Harley | 403/405.1 X |
| 4,981,388 | 1/1991 | Becken et al. | 403/403 X |

*Primary Examiner*—Karen J. Chotkowski
*Assistant Examiner*—Korie H. Chan

[57] ABSTRACT

An assembly which facilitate the capability of utilizing a plurality of horizontal panels with attachment brackets at end portions thereof for assembling standard types of barricades. A set of brackets includes one rectangular block bracket and two L-shaped angle iron brackets which are attached to each end portion of a horizontal panel. The rectangular block bracket is arranged between the two angled iron brackets such that two elongated grooves of a different width is defined therebetween so as to facilitate attachment of the horizontal panels to standards of different sizes.

1 Claim, 4 Drawing Sheets

HIGHWAY MARKER BRACKETS

BACKGROUND OF THE INVENTION

The present invention pertains in general to highway markers and, more particularly, to brackets designed to retain horizontal barricade panels on vertical posts.

Temporary barricades are distributed along the roadside to alert drivers to various hazardous conditions such as ongoing construction, defective roadways, etc. Since these barricades are placed unattended in close proximity to moving traffic, they experience a high degree of destruction by impact with automobile or truck. This normally requires frequent replacement of the barricades.

The aforementioned barricades consist of a multiple of horizontal panels. The multiple panels are previously assembled with hardware and a framework, and when placed along a roadside, the complete assembly is attached to a pair of stanchions or a support. The panels are designated by classes II and III; each character of the roman numeral designating the number of horizontal panels attached to the stanchions.

Heretofore, any barricade assembly with more than one horizontal panel has been permanently assembled as a unit prior to field installation with no means of easily re utilizing the panels for assembling different barricade types or easily replacing one panel at a time under normally adverse traffic conditions without tools.

There is an additional designation frequently used, which is designated as a type I barricade, indicating a single horizontal panel supported by brackets of a A frame design. These panels are normally manufactured to be utilized solely for the intended application.

In view of the above disadvantages, there exists a need for a series of brackets that may be attached to a barricade panel to enable the panel to be utilized in a variety of configurations and to additionally enable the panel to be easily placed and removed without requiring a variety of tools to accomplish this transition.

DESCRIPTION OF THE PREFERRED EMBODIMENT

Figure 1:
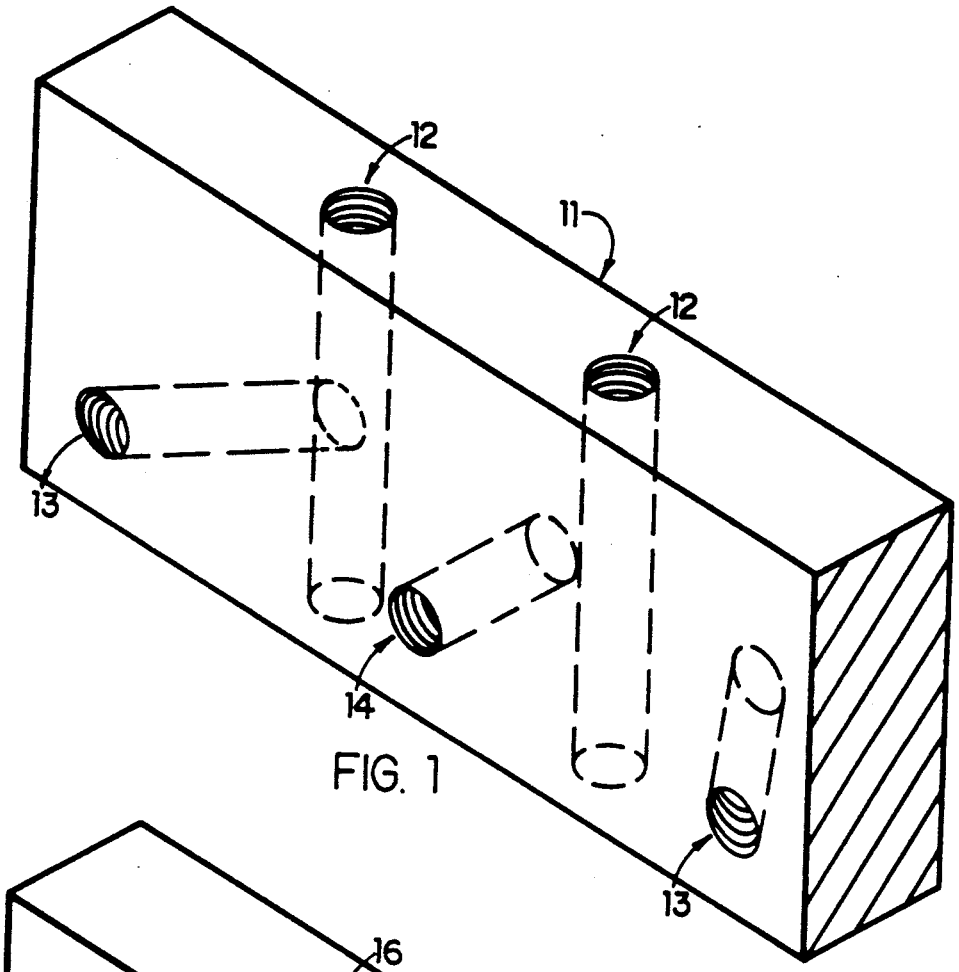
FIG. 1 is an isometric view of the primary stabilization bracket.

Referring now more specifically to the drawings wherein line reference characters designate like or corresponding parts throughout the several views. FIG. 1 illustrates a view of the primary stabilization bracket 11 drilled with orifices 12 utilized to attach the bracket to the horizontal panel 18 FIG. 3. The primary stabilization bracket 11 is also drilled with angular orifices 13 utilized for attachment to vertical post 19 FIG. 3 and orifice 14 utilized for attachment to vertical post 19 as will be shown in FIG. 7.

Figure 2:
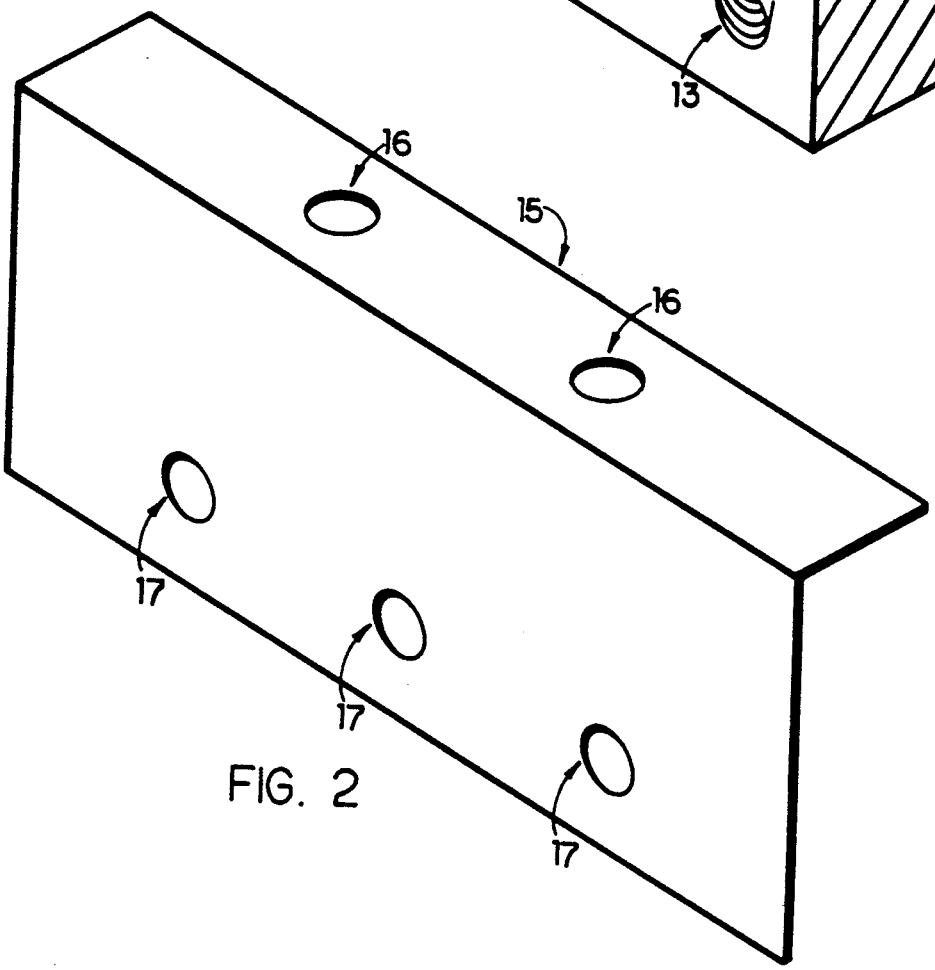
FIG. 2 is an isometric view of the secondary stabilization bracket.

Referring now to FIG. 2 there is shown the secondary stabilization bracket 15 which is drilled with orifices 16 for attachment to horizontal bracket 18 FIG. 8. The secondary stabilization bracket 15 is also drilled with orifices 17 utilized for attachment to vertical post 19 FIG. 3.

Figure 3:
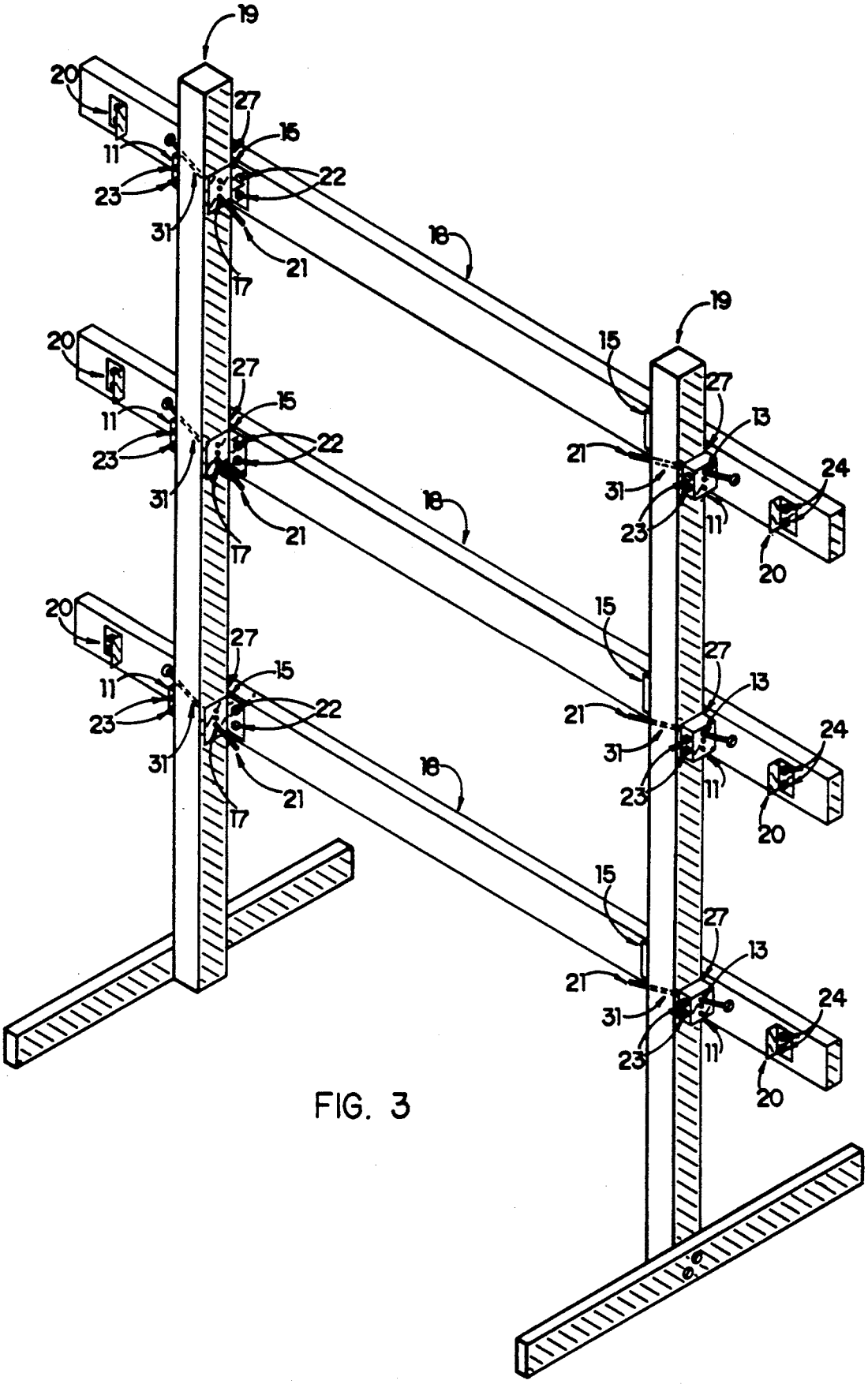
FIG. 3 is an isometric view of the horizontal panels attached the temporary vertical posts.
Figure 4:
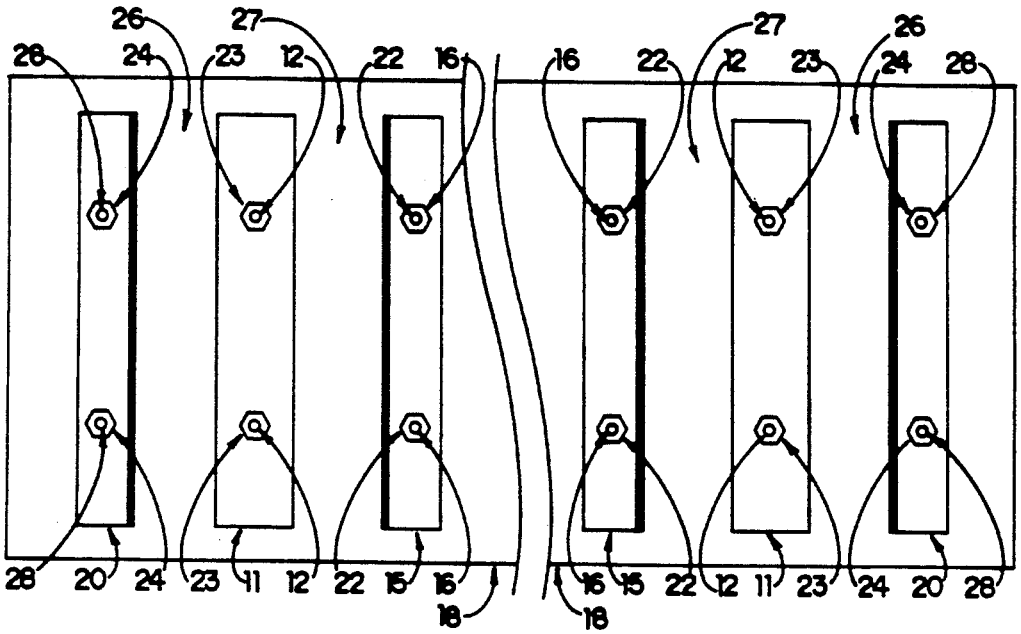
FIG. 4 is a longitudinal view of a single horizontal panel illustrating assembly details.

FIG. 4 now illustrates the assembly of the horizontal panel 18 where the outermost brackets 20 which may either be a standard section of angle iron or alternately, secondary attachment bracket 15, is attached by drilling holes 28 through horizontal panel 18 and securing with fasteners 24. Primary attachment brackets 11 are then secured with fasteners 23 through orifice 12 and holes drilled through horizontal panel 18 at an adequate distance from bracket 20 to form slot 27 which will accommodate stancion 25 FIG. 5 when it is utilized as a type I barricade. Secondary attachment brackets 15 are then secured with fasteners 22 through orifice 16 and holes drilled through horizontal panel 18 at an adequate distance from primary attachment bracket 11 to form slot 26, which will accommodate vertical post 19 FIG. 3 when the panel is utilized for either a type II barricade or a type III barricade as shown in FIG. 3.

Referring now to FIG. 3 there is shown the details of attachment of horizontal panels 18 to vertical posts 1 to form the standard type III barricade panel. Horizontal panels 18 are secured by passing vertical posts 19 through slots 27 and by securing with shalf 21, which pass through orifice 13 of primary stabilization brackets 11 then through holes 31 previously drilled through vertical posts 19 then through orifices 17 of secondary stabilization brackets 15. The reason for pre drilling holes 31 through vertical post 19 is to permit the user to assemble the panel without requiring any additional tools for assembly. Bracket 20, as shown, is not utilized in this configuration, but is still permanently attached to the panel when the panel is utilized for a type I barricade.

Figure 5:
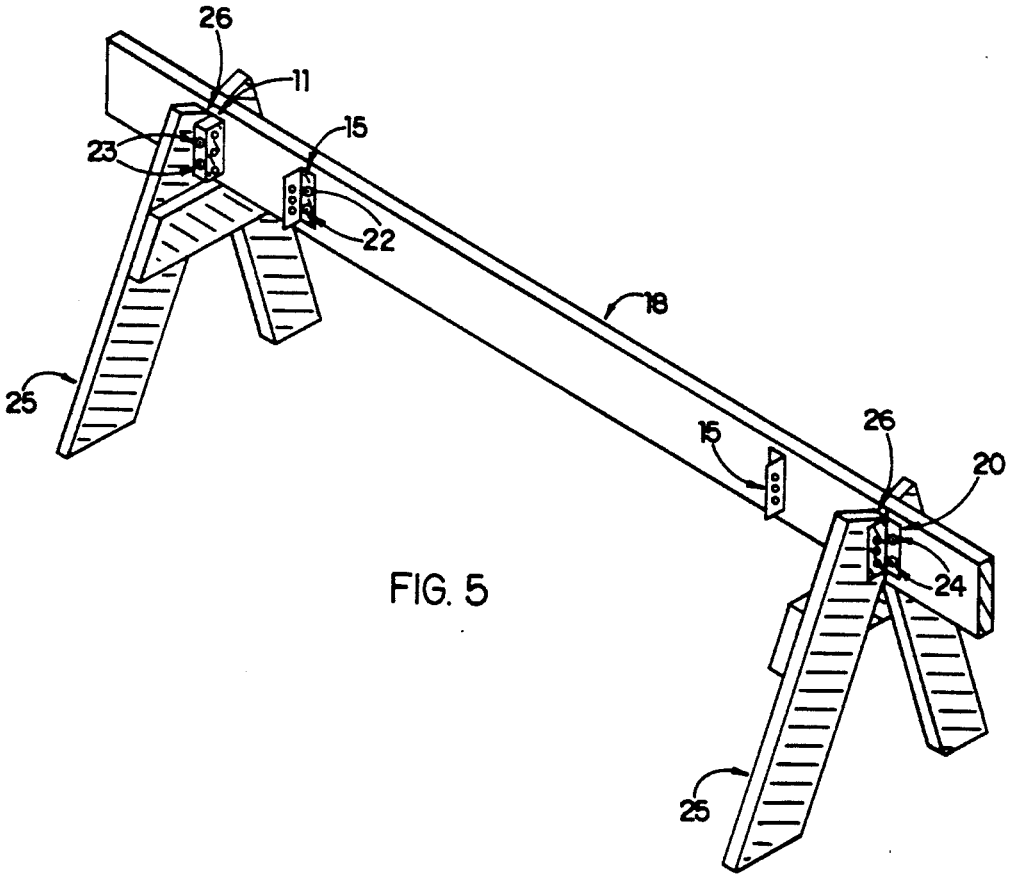
FIG. 5 is an isometric view of a single horizontal panel used additionally as a type I barricade.

Referring now to FIG. 5 there is shown horizontal panel 18 being utilized as a type I standard barricade by inserting stancions 25 through slots 26. Which are formed with brackets 20 and primary attachment brackets 11. Bracket 15, as shown, is not utilized in this configuration, but is still permanently attached to the panel when the panel is utilized for a type II or III barricade.

Figure 6:
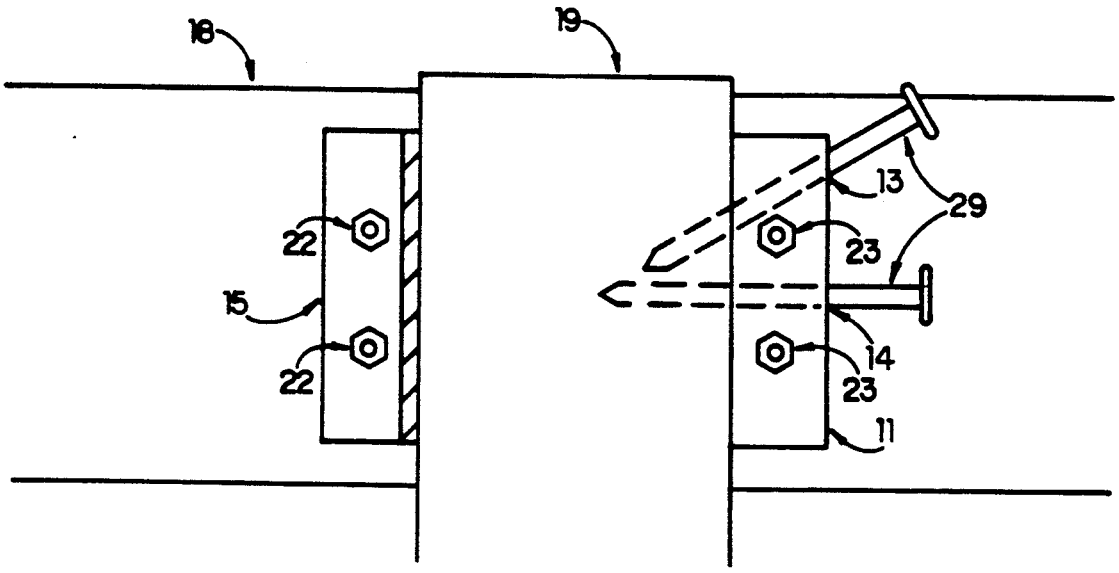
FIG. 6 is an optional assembly view of the brackets installed on a vertical post.

Referring now to FIG. 6 there is shown a circumstance wherein the hole 31 FIG. 3 may not be utilized for attachment due to irregular terrain or other constraints. This situation would occur in a ditch along a roadway where the vertical posts 19 would be set at different elevations and the panels 18 could not be secured to the vertical posts 19 through pre drilled holes 31 to maintain the required criteria of being placed parallel to the roadway surface for maximum visibility by motorists. The primary stabilization bracket 11 may then be temporarily attached by securing with nails 29 through orifices 13 and 14 and into vertical post 19. This is not the preferred method of assembly, for a supplementary tool such as a hammer is required for assembly and disassembly, thereby increasing the time involved. It may be utilized in emergency situations when, due to irregular terrain, when the stanchions may not be placed on the same elevation, the panels may still be installed parallel to the roadway surface utilizing the same stanchions.

Figure 7:
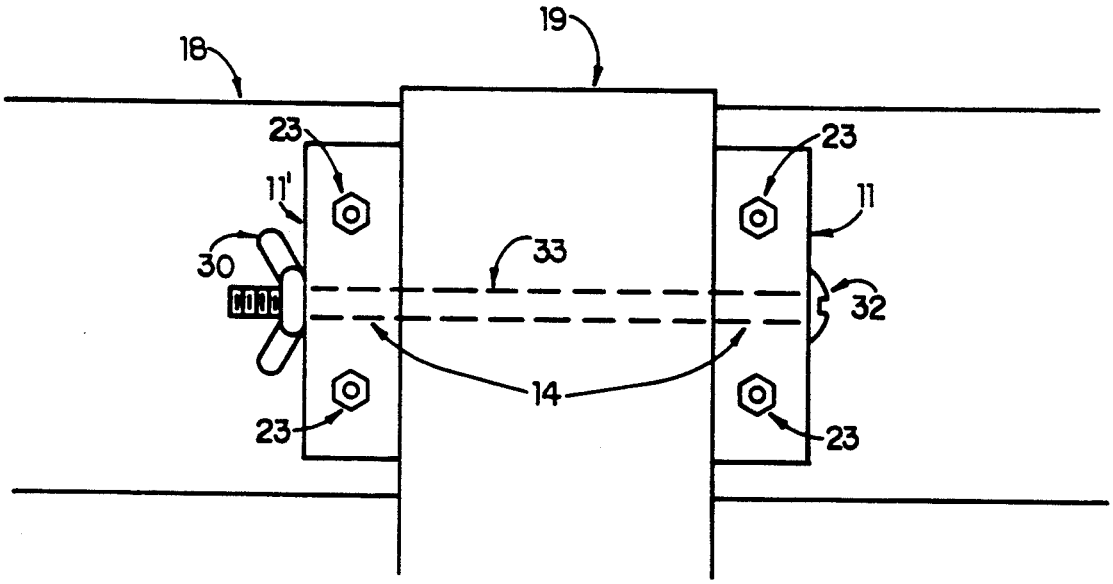
FIG. 7 is an optional assembly view of the brackets installed on a vertical post.

Referring now to FIG. 7 there is shown an alternate method of attachment that would be utilized when a more permanent method of attachment may be required. This is accomplished by inserting bolt 32 through orifice 14 of primary stabilization bracket 11, through hole 33 drilled through vertical post 19, through orifice 14 of primary stabilization 11 and then securing with wing nut 30. As is also illustrated, primary stabilization bracket 14 is substituted for secondary bracket 15, as shown in prior illustrations to illustrate an alternate method of assembly.

As is manifest from the preceding descriptions, the brackets utilized in the manner illustrated provide the flexibility of assembly and multiple usages of the horizontal panels, resulting in significant transportation, time and storage savings.

Although the preferred embodiment has been described in detail, it should be understood that various changes, substitutions and alterations can be made therein without departing from the spirit and scope of the invention as defined by the appended claims.

I claim as my invention:

1. An assembly capable of receiving standards of different sizes to facilitate building of various types of barricades comprising;

at least one elongated horizontal panel having two end portions;

a plurality of rectangular block brackets having a front surface, a rear surface opposite said front surface, a first side surface connecting said front and rear surfaces, and a second side surface opposite said first side surface and connecting said front and rear surfaces, a plurality of first orifices extending from said front surface to said rear surface, and a plurality of second orifices extending from the first side surface to said second side surface whereby the first orifices are offset from the second orifices;

a plurality of L-shaped angled iron brackets having a first surface connected to a second surface, a plurality of holes defined in said first and second surfaces;

a plurality of fasteners for extending through said first and second orifices and said holes for fastening said rectangular block brackets and said angled iron brackets to each of said end portions of said elongated panel; whereby each of said end portions of said elongated panel includes one of said rectangular blocks positioned between two of said angled iron brackets; wherein said first surfaces of said angled iron brackets are attached to said elongated panel via said fasteners extending through the holes of the first surface so that said second surface extends outwardly from said elongated panel; and said first side surface of said rectangular block bracket attached to said elongated panel via said fasteners extending through said second orifices so that said front and rear surfaces extend outwardly from said elongated panel; whereby said second surface of one of said angled iron brackets and said front surface of said rectangular block bracket define a first elongated groove of a first size therebetween, and said second surface of the other one of said angled iron brackets and said rear surface of said rectangular block bracket define a second elongated groove of a second size different from said first size therebetween; and at least one of said holes of said second surface is aligned 7ith at least one of said first orifices so as to receive one of said fasteners for retaining said standards in either the first or second grooves depending on the size of the standard.

* * * * *